United States Patent [19]

Franks, Jr.

[11] Patent Number: 4,626,051

[45] Date of Patent: Dec. 2, 1986

[54] UNIVERSAL GROUND CLAMP

[76] Inventor: George J. Franks, Jr., 261 Whitehall, Palatine, Ill. 60072

[21] Appl. No.: 756,755

[22] Filed: Jul. 18, 1985

[51] Int. Cl.[4] ..... H01R 4/66

[52] U.S. Cl. ..... 339/14 R; 339/251; 339/263 L; 339/272 R

[58] Field of Search ..... 339/14 R, 14 L, 263 L, 339/251, 272 R

[56] References Cited

U.S. PATENT DOCUMENTS 1,205,374 11/1916 Marcus ..... 339/251

1,210,764 1/1917 Cole ..... 339/272 R

FOREIGN PATENT DOCUMENTS 5066 of 1907 United Kingdom ..... 339/251

*Primary Examiner*—Eugene F. Desmond

*Attorney, Agent, or Firm*—August E. Roehrig, Jr.

[57] ABSTRACT

A universal ground clamp having a clamping strap formed of a corrosive-resisting copper or copper alloy having a series of uniformly sized and spaced apertures to facilitate the installation of the clamp onto a wide range of pipe, rod or conduit diameters. A brass stud, through which the clamping strap is secured, includes a terminal portion adapted to accommodate and have secured therein a terminated ground wire. A pair of curved plates supported upon the stud are used to form a tight clamping action of the copper strap about the pipe, rod or conduit to be grounded, without subjecting the strap to localized stresses or tearing, but permitting the strap to tightly encircle the pipe, rod or conduit and to be folded upon itself in a convergingly parallel manner.

10 Claims, 4 Drawing Figures

FIG. 1
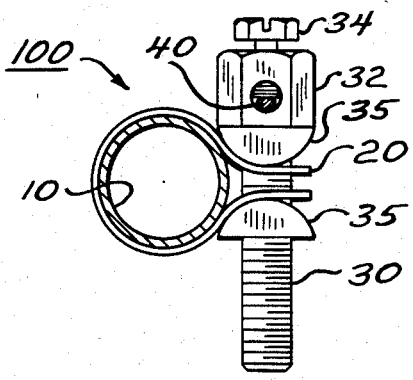
FIG. 2
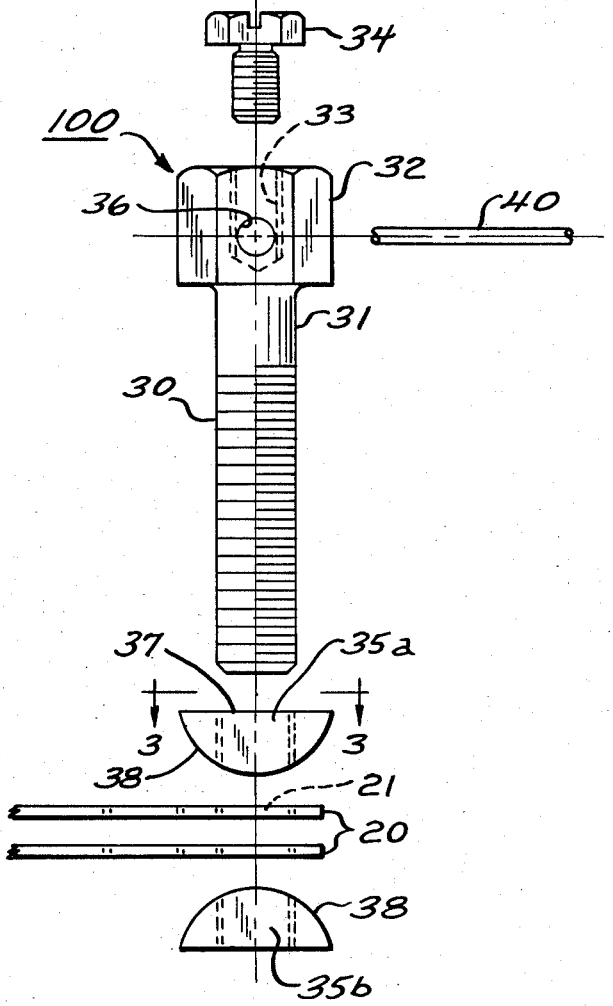
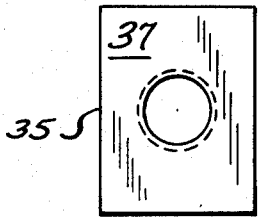
FIG. 3
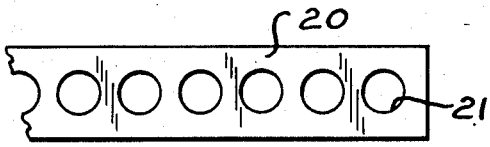
FIG. 4

UNIVERSAL GROUND CLAMP

BACKGROUND OF THE INVENTION

This invention relates in general to electrical grounding devices and, in particular, to a universal ground clamp for providing an electrical grounding coupling for use with a pipe, conduit or ground rods of various diameters. More specifically, but without restriction to the particular embodiments and/or use which are shown and described for purposes of illustration, this invention relates to a universal ground clamp adapted to accommodate such things as grounding conductors, water service pipes, electrical service conduits, and ground rods having diameters ranging from as small as ½" to as large as 3½".

As is known to those skilled in the art, ground clamps are utilized to provide an electrical ground for pipes and conduits, for example, to dissipate static electricity or whenever it is necessary to protect the safety of persons who might come into contact with such instrumentalities. In effecting such grounding, generally a solid copper wire of preferably AWG sizes 6 through 12 inclusive, is appropriately terminated to ground and then connected to the pipe or conduit by a clamp to effect grounding. However, the coupling of the terminated ground wire to the pipe or conduit to be grounded must be done in a proper manner to ensure an effective electrical connection between the pipe or conduit and the terminated ground wire. This coupling or connection must be maintained at all times free from corrosion and mechanical failure, both at the connection with the terminated ground wire, and at the connection to the rod, pipe or conduit.

While various clamping devices have been utilized to effect such a mechanical and electrical connection, these clamping devices are not generally usable for a wide range of pipe or conduit sizes. Therefore, an inventory of various clamp sizes must be maintained at all times to accommodate these varying sizes, in view of the rather limited range of size accommodation provided by the grounding clamps generally available.

When installing ground clamps, the clamping strap is tightened about the conduit to a predetermined specified torque in an attempt to ensure that the strap is secured to the conduit, but without an excessive force being applied to the clamping strap which might cause strap failure. In the past, prior art clamping devices have utilized a common hexagonally-shaped nut to tighten a clamping strap about the conduit to be grounded which has caused problems by failing to apply the full torquing force to secure the clamp onto the conduit. Since the curvature of the clamping strap passing about the conduit causes the clamping strap to engage the threaded stud at an angle, in such prior art devices the across-points dimension of a hex nut, being greater than the across-flats dimension, many times creates a false torque reading. Such a false reading occurs because of the manner in which the hex nut engages the angled clamping strap, whereby the larger across points dimension permits the edges of the hex nut to engage the clamping strap itself. This contact between the hex nut edge and the strap gouges the strap, and requires an increased force to turn the hex nut on the threaded stud which can erroneously be interpreted as the clamping force between the strap and the conduit. Such prior art devices not only damage the strap, but can fail to sufficiently secure the clamp to the conduit. The present invention protects against such a problem, and permits full utilization of torquing pressure for clamping.

Another problem associated with such prior art is the requirement of the simultaneous use of two tools in order to secure the clamp. In such prior art, when the hexagonal securing nut is tightened, the threaded stud will also rotate unless the stud head is held by the use of a second tool. In the confined spaces where such ground clamps are frequently utilized, the necessity of using two tools simultaneously makes installation difficult. The present invention eliminates the necessity of utilizing two tools in order to secure the clamp on the conduit.

SUMMARY OF THE INVENTION

It is, therefore, an object of this invention to improve ground clamps for joining a terminated ground wire to a pipe, rod or conduit for grounding purpose.

Another object of this invention is to accommodate a wide range of pipe, rod or conduit sizes through a single ground clamp adaptable to join a terminated ground wire to various sizes of conduits, pipes or rods.

A further object of this invention is to eliminate localized stresses or damage imposed on the joining or clamping strap of a ground clamp when the strap is tightly secured to the pipe, rod or conduit thereby minimizing strap failures or tearing.

Still another object of this invention is to provide an effective ground clamp which may be readily and easily installed to provide a coupling to a terminated ground wire for pipes, rods or conduits of no more than ½" in diameter, to no less than 3½" in diameter.

These and other objects are attained in accordance with the present invention wherein there is provided a universal ground clamp having a clamping strap formed of a corrosive-resisting copper or copper alloy having a series of uniformly sized and spaced apertures to facilitate the installation of the clamp onto a wide range of pipe, rod or conduit diameters. A brass stud, through which the clamping strap is secured, includes a terminal portion adapted to accommodate and have secured therein a terminated ground wire. A pair of curved plates are adjustably positionable along the stud to form a tight clamping action of the copper strap about the pipe, rod or conduit to be grounded, without subjecting the strap to localized stresses or damage, but permitting the strap to tightly encircle the pipe, rod or conduit and to be folded upon itself in a convergingly parallel manner.

DESCRIPTION OF THE DRAWINGS

Further objects of the invention, together with additional features contributing thereto and advantages accruing therefrom will be apparent from the following description of preferred embodiments of the invention which are shown in the accompanying drawings with like reference numerals indicating corresponding parts throughout, wherein:

FIG. 1 is a frontal planar view of the universal ground clamp coupled about a pipe to be grounded and having a terminated ground wire connected thereto;

FIG. 2 is an enlarged exploded view of the universal ground clamp to better illustrate the components thereof;

FIG. 3 is a top planar view of one of the curved plates utilized with the ground clamp taken along lines 3—3 of FIG. 2; and FIG. 4 is a top planar view of a coupling strap used with the ground clamp to better illustrate the manner in which a plurality of apertures or holes are formed therein to facilitate use of the ground clamp on various sizes of pipes, rods or conduits.

DESCRIPTION OF A PREFERRED EMBODIMENT

Referring now to FIG. 1, there is shown an embodiment of a universal ground clamp 100 in an assembled configuration with a clamp strap 20 secured about a pipe, conduit or rod 10 which is to be grounded. As shown in more detail in FIGS. 2, 3 and 4, this embodiment of the universal ground clamp includes a threaded stud 30 having a shank portion 31, void of thread, and a hexagonally shaped head 32 whereby the stud 30 may be turned relative to a pair of curved securing plates 35 each of which has an internal thread complementing the external thread on the stud 30.

The top of the hexagonally-shaped head 32 of the stud 30 has a threaded internal bore 33 coaxial with the longitudinal axis of the stud 30, and threaded to accommodate the external threads of a terminated ground wire securing screw 34 which functions to secure a terminated ground wire 40 to the stud 30. As best shown in FIG. 2, the head 32 of the stud 30 is formed with a bore 36 extending transversely of the longitudinal axis and passing completely through the stud head. In operation, the terminated ground wire 40, preferably of solid copper of AWG sizes 6 through 12 inclusive and terminated in a manner known to those skilled in the art, is positioned through the bore or hole 36 and the securing screw 34 is tightened fixedly securing the ground wire to the stud 30. In this manner, the terminated ground wire 40 is secured by a compression force of the securing screw 34 within the bore 36, without subjecting the ground wire to any shearing stress such as occurs in the prior art. FIG. 1 illustrates the clamp 100 in such an assembled condition.

To facilitate and accommodate the use of the universal ground clamp 100 on pipes, conduits or rods of varying diameters, the pair of curved securing plates 35 are threadingly engaged on the stud 30 with the uppermost one of the curved plates **35*a* being axially positioned at the shank portion 31 of the stud 30. The upper planar surface 37 is positioned in contact with the lower face of the stud head 32, as shown in an assembled configuration in FIG. 1. While the upper curved plate 35*a* is preferably threaded so that it will be retained on the shank portion 31 of stud 30, another embodiment could be utilized wherein the upper curved plate 35*a* has the hole formed therein which would be sufficiently large to allow the stud 30** to pass through without threaded engagement. If such an embodiment were used, the entire length of the stud could, if desired, be threaded.

The clamping strap 20 is preferably formed from a corrosive-resisting copper or copper alloy, and is positioned with the stud 30 passing through the first hole 21 formed adjacent to the end of the strap. The clamping strap 20 is formed with a series of equal diameter, equally spaced holes throughout its length, so that the clamping strap may be passed about pipes, conduits or rods of various diameters. After encircling the pipe 10, the stud 30 is again inserted through the strap and engaged by the second of the curved plates **35*b* which functions as a clamping nut to effect a secure clamping arrangement between the pipe, conduit or rod 30 and the clamping strap 20**.

As best shown in FIG. 1, when the clamping strap 20 has been passed about the conduit, pipe or rod to be grounded, and the lowermost curved plate **35*b* tightened in order to effect a secure joinder of the universal ground clamp 100 to the conduit 10, the configuration of the adjacent curved faces 38 of the securing plates 35 effect a smooth change in the direction or bend of the clamp strap preventing damage thereto. At the initial point of contact or "nip" formed between the conduit 10 and the face 38 of the curved plates 35*a*, the strap 20 is directed tangentially off of the conduit. The strap is thereafter curved by the face 38 of the plate 35*a* through the "throat" formed between the two adjacent curved plates 35, whereby the clamping strap 20** becomes wrapped upon itself with the two adjacent strap ends in parallel planes.

In this manner, when the stud 30 is turned, the uppermost curved plate **35*a*, being axially positioned upon the unthreaded shank portion 31, is maintained in a fixed position while the stud 30 rotates relative thereto. The lowermost curved plate 35*b* will be moved vertically relative to the uppermost curved plate 35*a* in response to rotation of the stud 30. The clamping strap 20 may thereby be drawn tightly about the conduit 10 without subjecting the clamping strap 20** to any edges which give rise to localized stress or can result in the tearing of the clamping strap during tightening. Through the use of such curved plates, the maximum torquing pressure is used for clamping and applied to secure the clamp to the conduit. This feature in combination with the series of uniformly spaced holes in the clamping strap permits the clamp to accommodate various sizes of conduits to which the universal ground clamp is to be attached, and prevents damage to the electrical coupling by eliminating localized stresses and/or damage to the clamping strap during installation.

While the invention has been described in the specification and illustrated in the drawings with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

I claim:

1. A clamping device for coupling an electrical ground to an object such as a conduit, pipe or ground rod comprising clamping strap means having at least a first and a second circular clearance hole formed therein and adapted to be placed about and in contact with at least a portion of the peripheral surface of an object to be grounded for forming an electrical and mechanical coupling thereto, fastening means for tightening said clamping strap means about an object to be grounded including a threaded stud positionable through said first and second circular clearance holes formed in said clamping strap means after said clamping strap means has been positioned about at least a portion of the peripheral surface of the object to be grounded, a first and a second securing plate supported on said threaded stud with said clamping strap means being positioned on said threaded stud between said securing plates, said first and second securing plates each being formed with a curved face having a substantially constant radius of curvature throughout the entire surface thereof which contacts said clamping strap means and supported on said threaded stud with said curved faces positioned adjacent each other with one of said curved faces on each side of said clamping strap means positioned therebetween, said first and second securing plates carried upon said threaded stud for converging movement relative to each other upon rotation of said stud to thereby tighten said clamping strap about an object to be grounded, and means for securing a terminated ground wire to said clamping device.

2. A clamping device as defined in claim 1 wherein said threaded stud has a shank portion void of threads and said first securing plate is supported upon said shank portion of said threaded stud which is void of threads.

3. A clamping device as defined in claim 2 wherein said first and second securing plates are both threaded for engagement with said threaded stud.

4. A clamping device as defined in claim 2 wherein one of said securing plates is formed with an aperture larger than the threaded portion of said stud.

5. A clamping device as defined in claim 1 wherein said means for securing a terminated ground wire to said clamping device includes a head portion formed at one end of said threaded stud, and said head portion has a hole extending therethrough in a direction transverse to the longitudinal axis of said threaded stud for receiving therein a terminated ground wire.

6. A clamping device as defined in claim 5 further including an internally threaded bore formed in said head portion, said internally threaded bore extending concentric with the longitudinal axis of said threaded stud and to a depth sufficient to intersect the transversely extending bore formed therein, and securing screw means having an external thread engageable with the internal thread formed in said head portion to exert a compressive force to releasably secure the terminated ground wire to said threaded stud upon the positioning of the ground wire in said transversely extending bore.

7. A clamping device as defined in claim 1 wherein said clamping strap means is formed with a series of uniformly spaced holes to facilitate mechanical coupling to various size objects to be grounded.

8. A clamping device as defined in claim 1 wherein said curved face of each of said first and second securing plates is formed to conform said clamping strap means in a configuration tangential with an object about which said clamping strap means is placed at a nip formed between the object and said curved face of said securing plates and extending therefrom over said curved faces into a position wherein the ends of said clamping strap means converge towards one another.

9. A clamping device as defined in claim 8 wherein said clamping strap means extends from said nip over the faces of said securing plates into a position wherein the ends of said clamping strap means lie in parallel planes at the point of engagement with said threaded stud.

10. A clamping device as defined in claim 1 wherein said curved face of each one of said first and second securing plates is curved from a point thereupon which defines the closest distance between said adjacent faces of said first and second securing plates to the edge thereof which in use is positioned adjacent to the peripheral surface of an object to be grounded.

* * * * *